US007255150B2

(12) United States Patent
Wu

(10) Patent No.: US 7,255,150 B2
(45) Date of Patent: Aug. 14, 2007

(54) VENETIAN BLIND WITH A STORAGE RAIL

(76) Inventor: Wen-Te Wu, No. 598, Lu-Tsao, Hsi-Ching Tsun, Lu-Tsao Hsiang, Chia-Yi Hsien (TW)

( * ) Notice: Subject to any disclaimer, the term of this patent is extended or adjusted under 35 U.S.C. 154(b) by 368 days.

(21) Appl. No.: 11/053,845

(22) Filed: Feb. 10, 2005

(65) Prior Publication Data

US 2006/0175024 A1 Aug. 10, 2006

(51) Int. Cl.
*E06B 9/30* (2006.01)

(52) U.S. Cl. ..... 160/168.1 R; 160/178.1 R

(58) Field of Classification Search ..... 160/178.1 R, 160/178.3, 168.1 R, 173 R, 176.1 R, 177 R
See application file for complete search history.

(56) References Cited

U.S. PATENT DOCUMENTS 4,441,540 A * 4/1984 Tsuhako ..... 160/168.1 R
4,886,102 A * 12/1989 Debs ..... 160/177 R
5,765,621 A * 6/1998 Bryant ..... 160/168.1 R
7,178,576 B2 * 2/2007 Nien et al. ..... 160/168.1 R

* cited by examiner

*Primary Examiner*—Blair M. Johnson
(74) *Attorney, Agent, or Firm*—Finnegan, Henderson, Farabow, Garrett & Dunner, L.L.P.

(57) ABSTRACT

A venetian blind includes a headrail, a storage rail, a covering unit and a retainer. The storage rail has front and rear sidewalls, each of which is formed with a horizontal rib. The storage rail further has two ends and an upper end opening disposed between the two ends. The retainer is configured as an inverted U-shaped plate, and bridges the front and rear sidewalls. The covering unit includes a plurality of horizontal slats. Lowermost ones of the slats are received within the storage rail, and are capable of being removed from the storage rail through the upper end opening. The retainer includes front and rear retaining-plate portions with open-ended slots engaging respectively the ribs of the storage rail, and is capable of being removed forcibly and upwardly from the storage rail.

7 Claims, 4 Drawing Sheets

VENETIAN BLIND WITH A STORAGE RAIL

BACKGROUND OF THE INVENTION

1. Field of the Invention

This invention relates to a venetian blind, and more particularly to a venetian blind that includes a plurality of horizontal slats and a storage rail that receives some of the slats to adjust the length of the venetian blind.

2. Description of the Related Art

U.S. Pat. No. 5,765,621 discloses a window blind that includes a storage rail or bottom rail, which defines a channel for receiving and storing unnecessary or unused slats of the window blind to enable the ready customization of the window blind to fit windows of different heights. Although the length of the window blind can be adjusted by receiving a selected number of the slats within the storage rail, it is difficult to perform such length adjustment of the window blind.

SUMMARY OF THE INVENTION

The object of this invention is to provide a venetian blind, the length of which can be adjusted with ease.

According to this invention, a venetian blind includes a headrail, a storage rail, a covering unit and a retainer. The storage rail has two ends, front and rear sidewalls, each having a horizontal rib, and an upper end opening disposed between the two ends. The retainer is configured as an inverted U-shaped plate, and bridges the front and rear sidewalls. The covering unit includes a plurality of horizontal slats. Lowermost ones of the slats are received within the storage rail, and are capable of being removed from the storage rail through the upper end opening. The retainer includes front and rear retaining-plate portions with open-ended slots engaging respectively the ribs of the storage rail, and is capable of being removed forcibly and upwardly from the storage rail. As such, the length of the venetian blind can be adjusted with ease.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
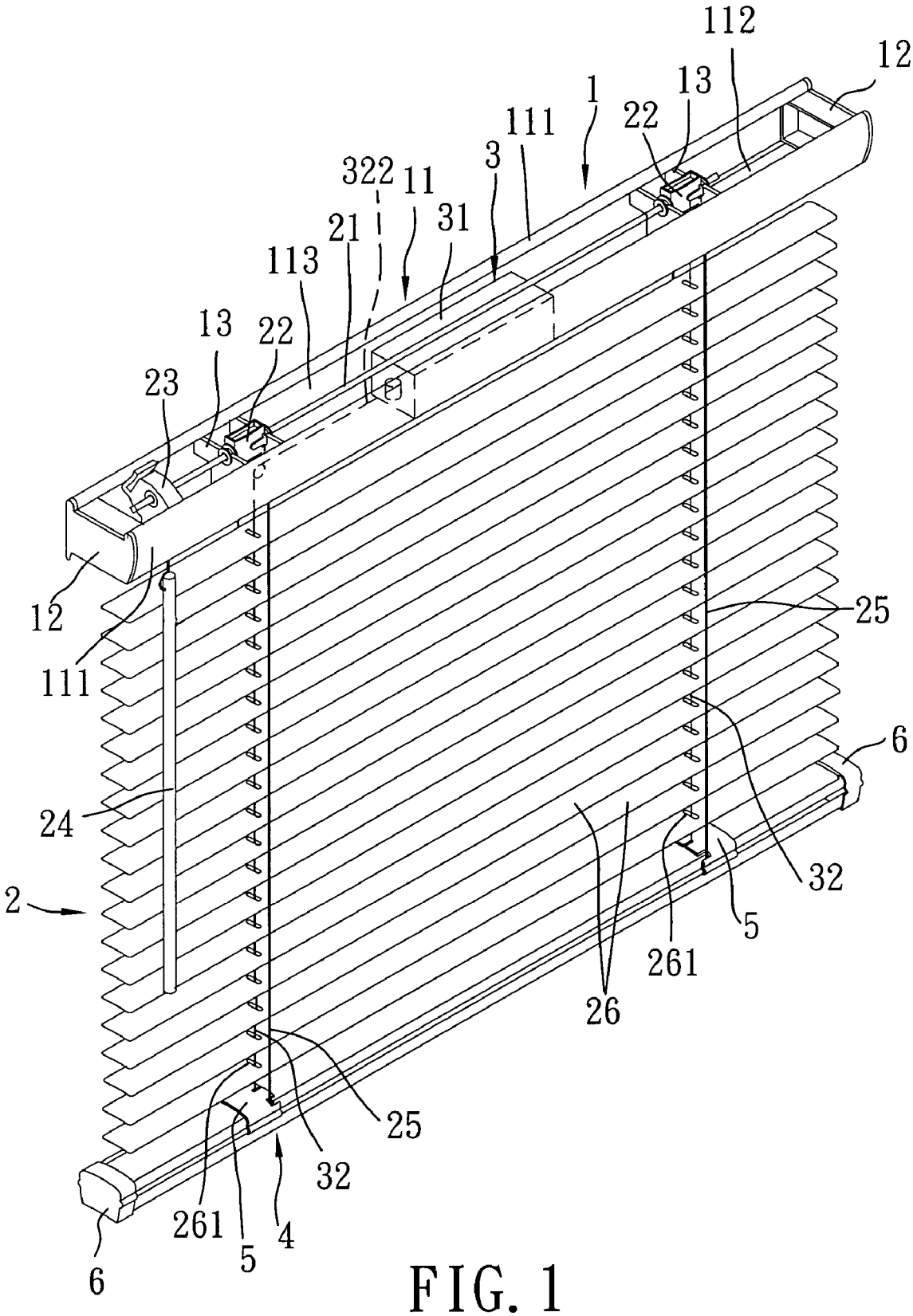
FIG. 1 is an assembled perspective view of the preferred embodiment of a venetian blind according to this invention.
Figure 2:
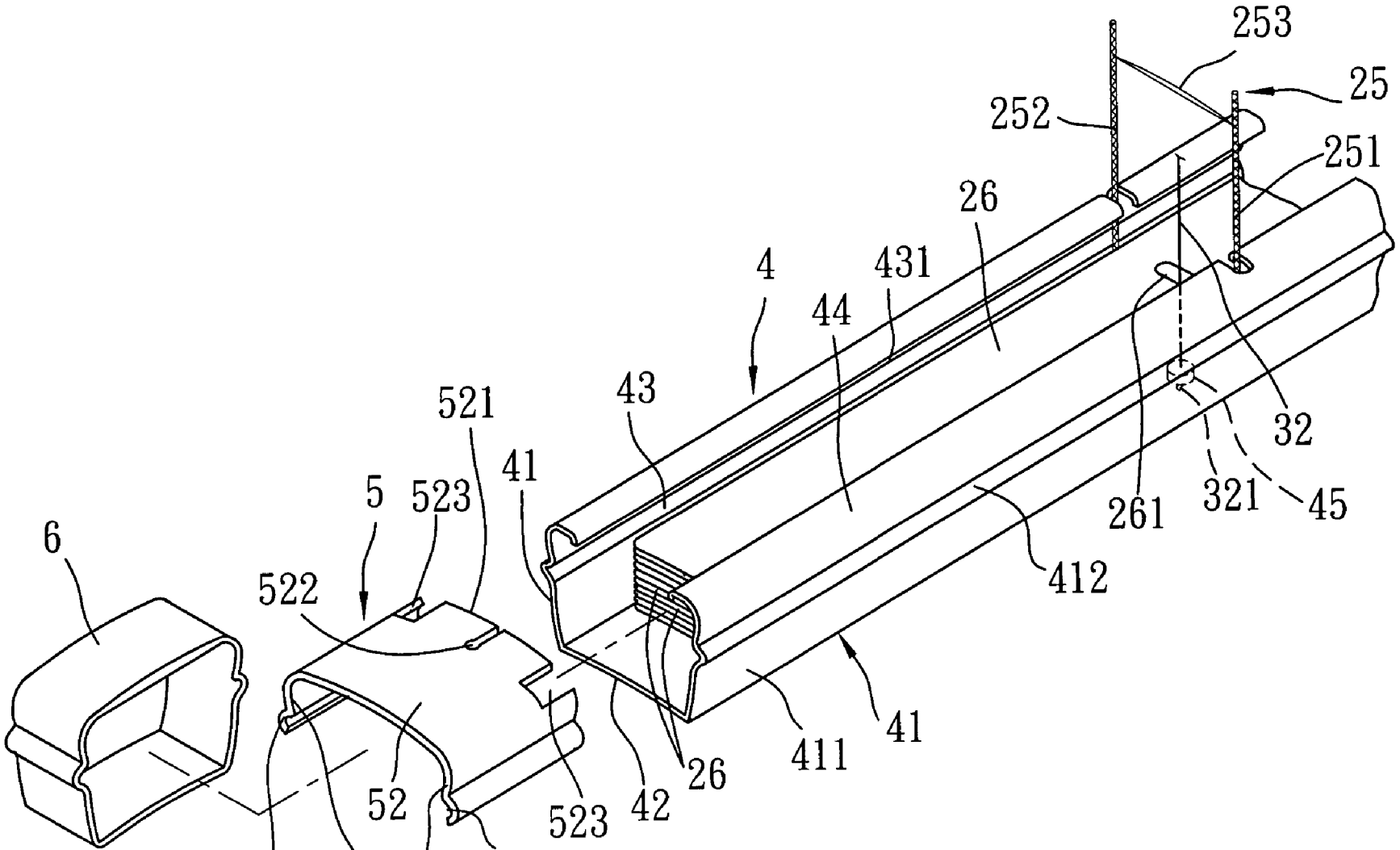
FIG. 2 is a partly exploded fragmentary perspective view of the first preferred embodiment.
Figure 3:
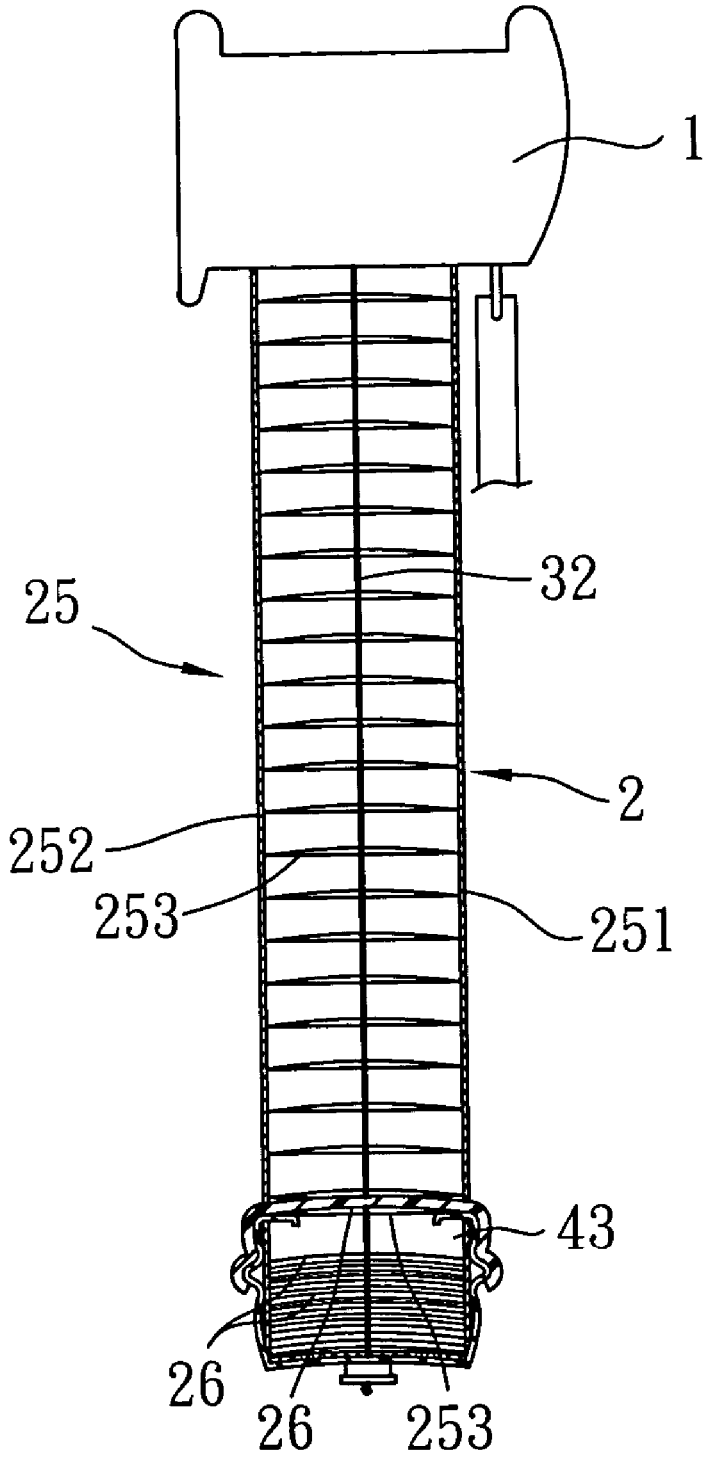
FIG. 3 is a sectional side view of the preferred embodiment.

Referring to FIGS. 1, 2 and 3, the preferred embodiment of a venetian blind according to this invention is shown to include a headrail 1, a covering unit 2, a cord-winding device 3, a storage rail 4, two retainers 5 and two end caps 6.

The headrail 1 is mounted fixedly on a wall (not shown), and includes a rail body 11, two covers 12 press-fitted respectively within two opposite ends of the rail body 11, and two supporting members 13 disposed within the rail body 11 between the covers 12. The rail body 11 includes a pair of vertical front and rear walls 111, a horizontal bottom wall 112, and an accommodating space 113 defined among the front and rear walls 111 and the bottom wall 112. The front and rear walls 111 extend respectively, integrally, and upwardly from opposite front and rear sides of the bottom wall 112.

The covering unit 2 is disposed between the headrail 1 and the storage rail 4, and includes a light-adjusting rod 21 disposed rotatably on the supporting members 13, two cord-connecting elements 22 connected respectively and fixedly to two opposite ends of the light-adjusting rod 21, a driving member 23 disposed within the accommodating space 113 in the headrail 1 and driven to rotate the light-adjusting rod 21 by a selected angle, a vertical controlling rod 24 connected to the driving member 23 and operable to drive the driving member 23, two ladder cords 25 fastened respectively to the cord-connecting elements 22 at upper ends thereof, and a plurality of horizontal slats 26 disposed on said ladder cords 25. Each of the ladder cords 25 has a vertical front cord portion 251 disposed in front of the slats 26, a vertical rear cord portion 252 disposed behind the slats 26, and a slat-supporting cord portion 253 interconnecting the front and rear cord portions 251, 252. The slat-supporting cord portions 253 support the slats 26 respectively thereon. When the controlling rod 24 is operated, the light-adjusting rod 21 and the cord-connecting elements 22 rotate, as described above. This causes the slat-supporting cord portions 253 and therefore, the slats 26 to tilt. Since the process involved in adjusting the angle of the slats 26 is known in the art and is not pertinent to the claimed invention, a detailed description thereof will be omitted herein for the sake of brevity. Lowermost ones of the slats 26 can be received within the storage rail 4, as shown in FIG. 3, to adjust the maximum length of the covering unit 2, i.e., the length of the covering unit 2 in a completely lowered state.

The cord-winding device 3 includes a winding unit 31 disposed within the accommodating space 113, and two lifting cords 32. The lifting cords 32 extend respectively through two holes 261 (see FIG. 1) in each of the slats 26. Each of the lifting cords 32 extends through the storage rail 4, and has a lower end 321 (see FIG. 2) and an upper end 322 (see FIG. 1) that is connected to the cord-winding unit 31 in a known manner. The winding unit 31 imparts a spring force to balance the total weight of the covering unit 2 and the storage rail 4 so as to maintain the storage rail 4 at any position with respect to the headrail 1. Since the structure and operation of the cord-winding device 3 are known to those skilled in the art, further description thereof will be omitted herein for the sake of brevity. The number of the lifting cords 32 and the ladder cords 25 can be changed according to the size and weight of the covering unit 2.

The storage rail 4 is disposed under the covering unit 2, and is longer than the slats 26. The storage rail 4 includes a pair of upright front and rear sidewalls 41, and a horizontal bottom wall 42 having two opposite sides formed respectively and integrally with lower ends of the front and rear sidewalls 41 to define a storage space 43 among the bottom wall 42 and the front and rear sidewalls 41. The storage space 43 is slightly wider than the slats 26. Each of the lifting cords 32 extends through the bottom wall 42 of the storage rail 4, and is formed with a stop element 45 (see FIG. 2) at the lower end 321, which abuts against a bottom surface of the bottom wall 42 so as to retain the lifting cords 32 on the bottom wall 42.

Each of the front and rear sidewalls 41 has an upright plate portion 411 and a horizontal rib 412 formed on an outer surface of the upright plate portion 411. The storage rail 4 further includes two top cover portions 44 extending respectively and integrally from upper ends of the front and rear sidewalls 41 toward each other. The lowermost slats 26 are disposed between the bottom wall 42 and the top cover portions 44. The top cover portions 44 are spaced apart from each other by a distance that is smaller than the width of each of the slats 26. As such, in order to move one of the slats 26 through a space between the top cover portions 44, it is necessary to tilt the same.

The retainers 5 are made of a plastic material, and bridge the front and rear sidewalls 41 of the storage rail 4. Each of the retainers 5 is configured as an inverted U-shaped plate, and includes a pair of front and rear retaining-plate portions 51 and a top plate portion 52. The top plate portion 52 has two opposite sides that are formed respectively and integrally with upper ends of the front and rear retaining-plate portions 51. Each of the front and rear retaining-plate portions 51 has an inner surface that is formed with a slot 511, which has two open ends and which engages the corresponding rib 412 of the storage rail 4. As such, the retainers 5 are retained on the storage rail 4 so as to prevent removal of the lowermost slats 26 from the storage rail 4. The top plate portion 52 of each of the retainers 5 has an outer periphery 521 that is formed with a lifting-cord notch 522 and two ladder-cord notches 523. The lifting-cord notch 522 is disposed between the ladder-cord notches 523. The lifting cords 32 extend respectively through the lifting-cord notches 522 in the retainers 5. Therefore, the lifting cords 32 can be guided to move on the storage rail 4 along a straight path. The front and rear cord portions 251, 252 of the ladder cords 25 extend respectively through the ladder-cord notches 523 in the retainers 5. Therefore, the ladder cords 25 can be guided to move along a straight path. The retainers 5 can be pulled upwardly to separate from the storage rail 4.

The end caps 6 are sleeved respectively and fixedly on two opposite ends of the storage rail 4. The end caps 6 are provided for aesthetic reasons and to provide rigidity to the storage rail 4. An upper end opening 431 (see FIG. 2) is defined between the top cover portions 44 of the storage rail 4 and between the end caps 6. Each of the retainers 5 covers a portion of the upper end opening 431. The upper end opening 431 is longer than the slats 26 so as to allow for movement of the same therethrough.

Figure 4:
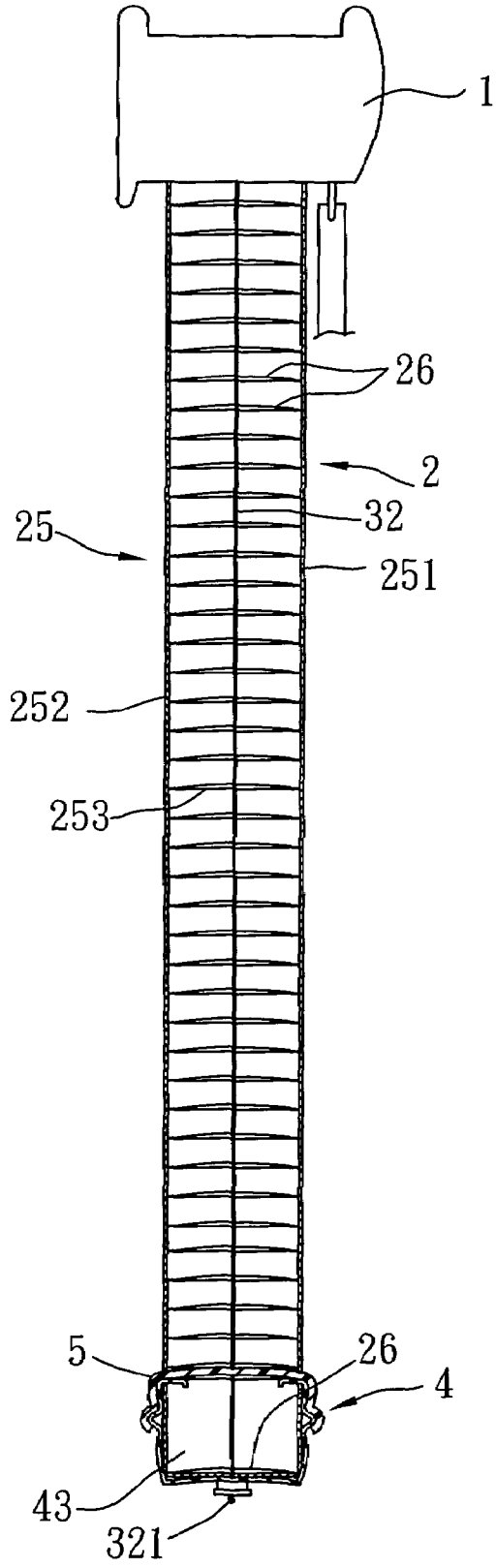
FIG. 4 is a sectional side view of the preferred embodiment, illustrating how the length of a covering unit is adjusted.

In use, when the venetian blind is initially mounted to a window (not shown), it is completely lowered and opened, as shown in FIG. 4. Subsequently, the lowermost ones of the slats 26, which are disposed below a bottom edge of the window, are received within the storage rail 4. As such, the venetian blind of this invention can fit windows of different heights. Preferably, one of the slats 26 is clamped between the top plate portions 52 of the retainers 5 and the top cover portions 44 of the storage rail 4. This prevents dust from entering into the storage rail 4.

The advantages of the venetian blind of this invention can be summarized as follows:

(1) The length of the venetian blind can be adjusted with ease.

(2) The structure of the venetian blind is relatively simple. Therefore, the manufacturing costs of the venetian blind are reduced.

(3) The lifting cords 32 are fastened to the storage rail 4 by means of the stop elements 45, which are disposed under the bottom wall 42 of the storage rail 4 and not within the storage space 43. Thus, efficient use of the storage space 43 in storing the slats 26 is realized.

With this invention thus explained, it is apparent that numerous modifications and variations can be made without departing from the scope and spirit of this invention. It is therefore intended that this invention be limited only as indicated by the appended claims.

I claim:

1. A venetian blind comprising:

a headrail;

a storage rail disposed under said headrail and having two ends, a pair of front and rear sidewalls connected fixedly to each other, and an upper end opening formed in said storage rail between said ends and between said front and rear sidewalls, each of said front and rear sidewalls having an outer surface that is formed with a horizontal rib;

a covering unit disposed between said headrail and said storage rail and including a plurality of slats, and at least two ladder cords suspended from said headrail and interconnecting said slats, lowermost ones of said slats being received within said storage rail; and at least one flexible retainer configured as an inverted U-shaped plate that includes a pair of front and rear retaining-plate portions, each of said front and rear retaining-plate portions having an inner surface that is formed with a horizontal slot which has two open ends, said ribs of said front and rear sidewalls of said storage rail engaging respectively said slots in said front and rear retaining-plate portions of said retainer so as to retain said retainer on said storage rail, said retainer bridging said front and rear sidewalls of said storage rail so as to cover a portion of said upper end opening in said storage rail, thereby preventing removal of said lowermost ones of said slats from said storage rail through said upper end opening in said storage rail, said retainer being removable forcibly and upwardly relative to said storage rail so as to allow for the removal of said lowermost ones of said slats from said storage rail through said upper end opening in said storage rail.

2. The venetian blind as claimed in claim 1, wherein said storage rail further has a bottom wall interconnecting lower ends of said front and rear sidewalls, and two top cover portions that extend respectively from upper ends of said front and rear sidewalls toward each other, said upper end opening being disposed between said top cover portions, said lowermost ones of said slats being disposed between said front and rear sidewalls and between said bottom wall and said top cover portions.

3. The venetian blind as claimed in claim 2, wherein said storage rail further includes two end caps sleeved respectively and fixedly on said ends of said storage rail so as to define said upper end opening between said end caps, said lowermost ones of said slats being disposed between said end caps.

4. The venetian blind as claimed in claim 2, further comprising a cord-winding device that includes:

a pair of lifting cords, each of said lifting cords having an upper end and a lower end that is fastened to said bottom wall of said storage rail; and a winding unit disposed within said headrail and connected to said upper ends of said lifting cords, said winding unit imparting a spring force to balance a total weight of said covering unit and said storage rail so as to maintain said storage rail at any position with respect to said headrail.

5. The venetian blind as claimed in claim 4, wherein said retainer has a top plate portion that is formed with a lifting-cord notch at an outer periphery thereof, one of said lifting cords extending through said lifting-cord notch in said top plate portion of said retainer.

6. The venetian blind as claimed in claim 4, wherein said lifting cords extend through said bottom wall of said storage rail, said lower end of each of said lifting cords being formed with a stop element that abuts against a bottom surface of said bottom wall of said storage rail so as to retain said lifting cords on said bottom wall of said storage rail.

7. The venetian blind as claimed in claim 1, wherein each of said ladder cords has a vertical front cord portion disposed in front of said slats, a vertical rear cord portion disposed behind said slats, and a slat-supporting cord portion interconnecting said front and rear cord portions so as to support a respective one of said slats thereon, said retainer further including a top plate portion that has two opposite sides which are connected respectively and fixedly to upper ends of said front and rear retaining-plate portions, said top plate portion of said retainer having an outer periphery that is formed with two ladder-cord notches, said front and rear cord portions of one of said ladder cords extending respectively through said ladder-cord notches in said top plate portion of said retainer.

* * * * *